United States Patent [19]

Gerber

[11] Patent Number: 4,616,543

[45] Date of Patent: Oct. 14, 1986

[54] APPARATUS FOR WORKING ON WOVEN FABRIC WOUND ON A SUPPLY ROLL

[75] Inventor: Heinz J. Gerber, West Hartford, Conn.

[73] Assignee: Gerber Scientific, Inc., South Windsor, Conn.

[21] Appl. No.: 607,618

[22] Filed: May 7, 1984

Related U.S. Application Data

[63] Continuation-in-part of Ser. No. 284,783, Jul. 20, 1981, abandoned.

[51] Int. Cl.[4] ..... D06H 7/00

[52] U.S. Cl. ..... 83/175; 83/14; 83/367; 83/649; 83/701; 83/925 CC; 26/1; 26/51; 28/247; 28/170

[58] Field of Search ..... 83/14, 17, 18, 175, 83/176, 367, 649, 650, 701, 925 CC; 226/1, 88, 200; 26/1, 18.5, 19, 20, 51, DIG. 1; 68/3 SS; 28/247, 281, 282; 270/31

[56] References Cited

U.S. PATENT DOCUMENTS

| | | | |
|---|---|---|---|
| 1,105,309 | 7/1914 | Samuel et al. | 28/170 |
| 1,109,184 | 9/1914 | Schultz | 28/170 |
| 1,909,016 | 5/1933 | Schultz | 28/170 |
| 2,766,504 | 10/1956 | Beeby | 28/170 |
| 2,943,377 | 7/1960 | Frieberger | 28/247 X |
| 3,474,509 | 10/1969 | Bray | 26/1 X |
| 3,627,301 | 12/1971 | Benson et al. | 270/31 |
| 3,672,661 | 6/1972 | Gerber et al. | 270/31 |
| 3,782,649 | 1/1974 | Frederick et al. | 270/31 X |
| 3,796,117 | 3/1974 | Mukai et al. | 83/367 X |
| 3,835,741 | 9/1974 | Anderson et al. | 83/71 |
| 3,855,887 | 12/1974 | Pearl et al. | 83/49 |
| 3,864,997 | 2/1975 | Pearl et al. | 83/49 |
| 4,391,170 | 7/1983 | Boverman et al. | 83/71 |

*Primary Examiner*—James M. Meister

*Attorney, Agent, or Firm*—McCormick, Paulding & Huber

[57] ABSTRACT

Programmable apparatus for cutting woven fabric wound on a supply roll includes a fabric spreader which pays-off fabric from the supply roll and onto a cutting table as the spreader moves relative to the table. A vibrating member carried by the fabric spreader and over which the payed-off fabric is constrained to pass imparts vibration to a portion of the fabric which extends across the entire width of the fabric to relieve residual stresses within the fabric as it is spread onto the table surface. The spread fabric is immediately cut by a rotary cutting wheel which moves in cutting engagement with the fabric in response to command signals received from a programmable controller.

13 Claims, 3 Drawing Figures

APPARATUS FOR WORKING ON WOVEN FABRIC WOUND ON A SUPPLY ROLL

CROSS-REFERENCE TO RELATED APPLICATION

This application is a continuation-in-part of application Ser. No. 284,783, filed July 20, 1981, now abandoned, and hereby incorporated by reference as part of the present disclosure.

BACKGROUND OF THE INVENTION

This invention relates in general to apparatus and methods for working on sheet material and deals more particularly with improvements in apparatus and methods for performing a repetitive size-dependent work operation on woven fabric wound on and fed from a supply roll.

The fabrics with which the present invention is concerned, and which include wool, cotton and synthetic materials, comprise fibers which have a developed surface texture characterized by fuzzy surface projections, or the like, which tend to adhere or interlock with projections on adjacent fibers or threads in the fabric or web. Such characteristics are generally desirable in a fabric and prevent the threads which comprise the fabric from becoming displaced relative to each other within the fabric web structure, thereby maintaining the integrity of the structure.

In the manufacture of articles from such fabric, it is customary for the fabric to be made-up into rolls or bolts to facilitate convenient handling and storage. However, the process of winding fabric to form a roll or bolt inevitably subjects the fabric to stretching forces resulting in tensional, compressional, bending, shearing, and twisting stresses within the bodies of the threads which comprise the fabric. Further, adjacent surface projections on each thread or fiber tend to interlock or become entangled with each other and with the surface projections on adjacent threads or fibers and resist the release of stresses within the wound fabric when the fabric is payed-off the roll or bolt. More specifically, adjacent entangled surface projections on the curved inner side of each fiber of the wound fabric, which are compressed relative to each other when the fabric is wound, resist separation in tension as the cloth is payed-off the supply roll, whereas adjacent entangled surface projections on the curved outer side of the fibers, which are subjected to tension when the fabric is wound, are forced toward each other and also resist separation as the fabric is straightened and tangentially payed-off the supply roll S. The residual internal stresses within the fibers and the additional stresses produced by the interlocking surface projections resist relaxation or shrinkage of the spread fabric. Creep is a function of time, therefore, when the stresses responsible for this phenomenon are relieved, as by unrolling or spreading the fabric, the fabric will relax and undergo slow return to its normalized or unstressed dimensions.

An accepted procedure for stress relieving wound fabric is to unwind the fabric, spread the material upon a supporting surface and allow sufficient time for it to relax or shrink to its proper size. Only then can cutting, printing or other size-dependent operations be performed on the material. However, this waiting period may result in costly machine downtime. Further, the provision of special table facilitaties to accommodate the fabric during the waiting period, while it is allowed to relax, adds further to the cost of the fabric processing operation in the form of additional equipment and increased floor space requirements. The present invention is concerned with the aforesaid problems.

SUMMARY OF THE INVENTION

An apparatus for working on woven fabric wound on a supply roll comprises means defining a supporting surface upon which fabric is spread, a fabric spreader for carrying the supply roll and supported for movement in one and an opposite direction longitudinally of the supporting surface, means for moving the fabric spreader in one and an opposite direction longitudinally of the supporting surface, means for paying-off fabric from the supply roll and onto the supporting surface as the spreader moves longitudinally of the supporting surface, a transversely extending vibratory member disposed between the supply roll and the supporting surface for engaging an associated portion of the fabric as the fabric is payed-off the supply roll and onto the supporting surface, means for vibrating the member in engagement with the fabric as the fabric is payed-off of the supply roll and onto the supporting surface, an instrument for the performing a size-dependent work operation on the fabric spread on the supporting surface, and means for moving the instrument longitudinally and transversely of the supporting surface and in working relation to fabric spread on the supporting surface. Fabric wound on a supply roll is payed-off of the roll and spread onto the supporting surface. A portion of the fabric located between the supply roll and the supporting surface is vibrated while the fabric is being payed-off the supply roll and spread onto the supporting surface to relax and normalize the fabric. A size-dependent work operation is immediately performed on the spread fabric.

DETAILED DESCRIPTION OF PREFERRED EMBODIMENT AND METHODS

Figure 1:
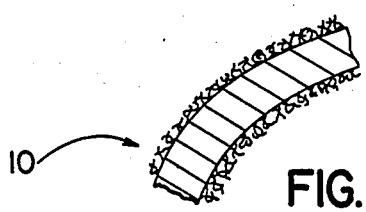
FIG. 1 is a somewhat schematic fragmentary axial sectional view through a thread which comprises part of a fabric wound on a supply roll.

In the drawing, and in the description which follows, the present invention is illustrated and described with reference to an apparatus for performing a size-dependent operation on woven fabric wound on a supply roll. The fabric, which may, for example, comprise cotton, wool or a synthetic material comprises a web of woven filaments or threads characterized by developed surfaces which include irregularly shaped projections which may, for example, have a fuzzy texture These surface projections tend to interengage and interlock or otherwise become intertwined or entangled with adjacent like projections on the same or adjacent threads and in FIG. 1 a portion of a typical thread which comprises a part of a woven fabric is illustrated somewhat schematically and indicated generally by the reference numeral 10. When such a thread is bent, as shown, in a winding or spooling operation, compressional and tensional stresses are developed within the body of the thread at opposite sides of its central axis, in a manner well known in the art. Additional stresses are or may be developed within each thread in the weave due to tension applied to the fabric during the the winding operation. Further, stresses are developed around the outer surface of each thread due to the interengagement or entanglement of the surface projections on the thread itself or with the surface projections on other of the threads which comprise the weave. As a result of these stresses, a temporary elongation of the fabric web usually occurs when the web is wound to form a roll or bolt. The apparatus and methods of the present invention are primarily concerned with effecting substantially immediate relief or relaxation of these stresses to normalize the fabric so that size-dependent operations, such as pattern piece cutting or marking operations, may be immediately performed upon the fabric when it is unwound from the supply roll and without serious risk of subsequent creep resulting in dimensional changes in the material which may cause serious errors in the size and/or the shape of the finished goods.

Figure 2:
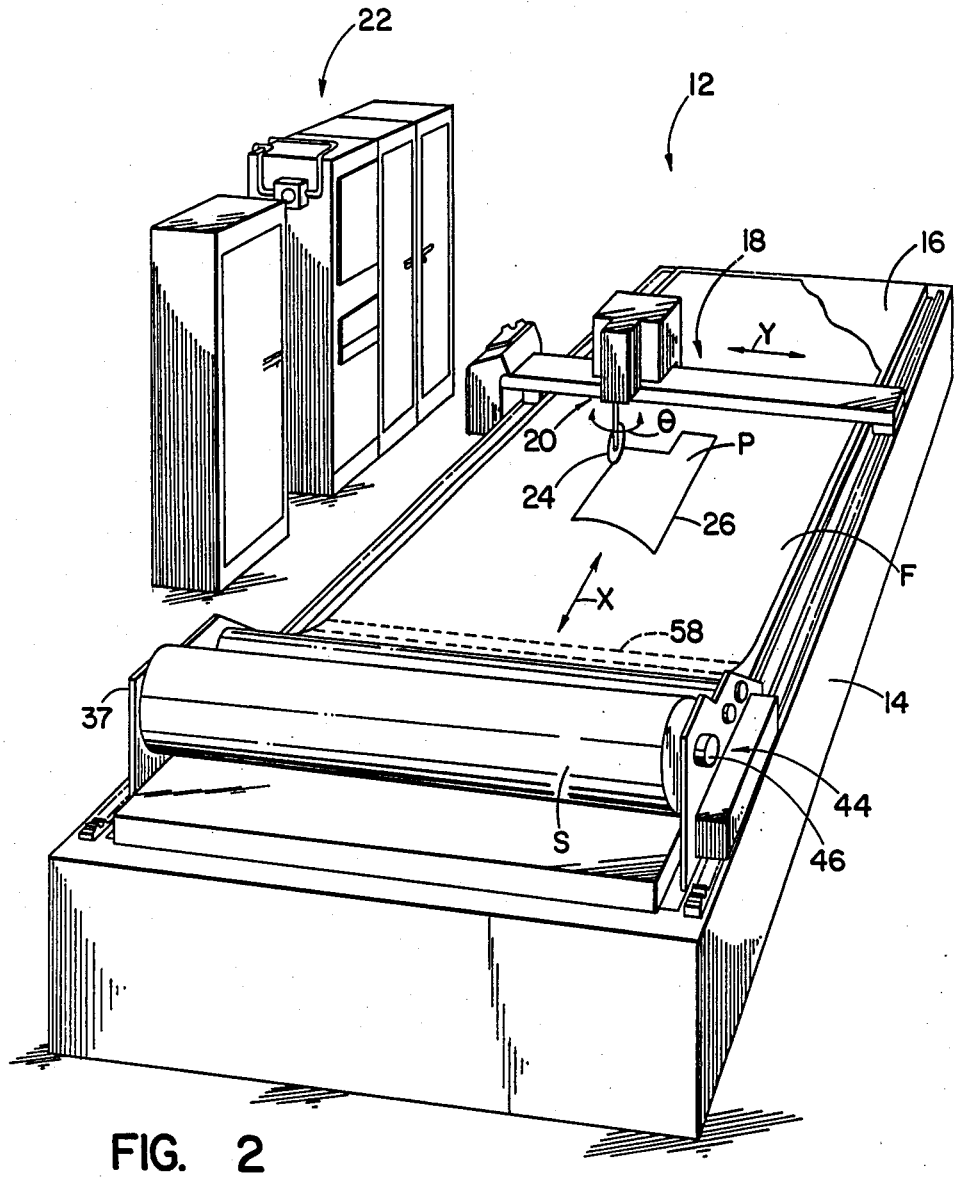
FIG. 2 is a perspective view of an apparatus embodying the present invention and used in practicing the methods of the present invention.
Figure 3:
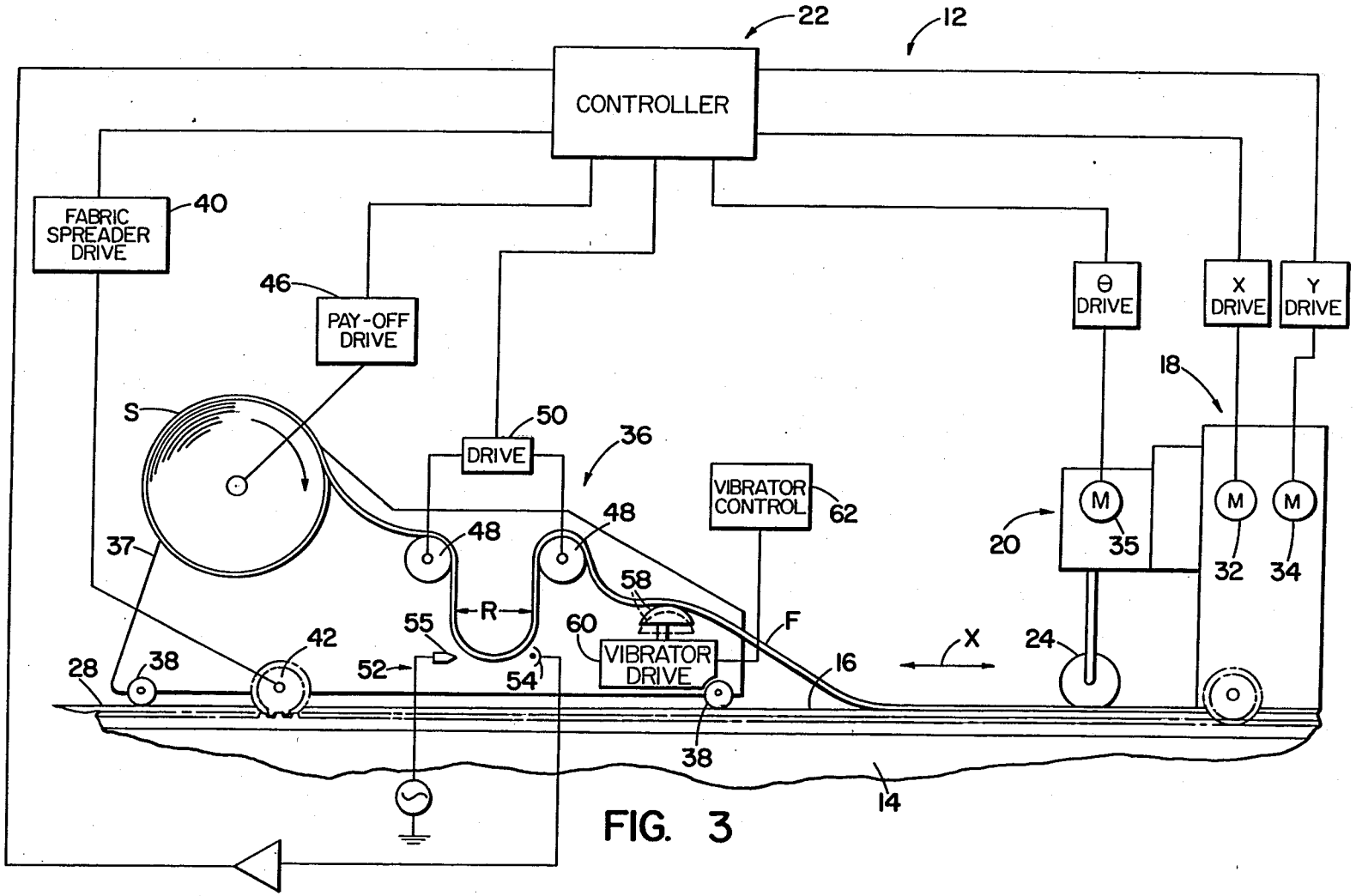
FIG. 3 is a somewhat schematic fragmentary side elevational view of the apparatus shown in FIG. 2.

Turning now to FIGS. 2 and 3, a typical apparatus embodying the present invention and used in practicing methods of the invention is indicated generally by the reference numeral 12. The illustrated apparatus 12 is particularly adapted for performing a size-dependent operation on woven fabric, indicated by the letter F and stored on a supply roll S. More specifically, the apparatus 12 is adapted for spreading a layup of fabric and cutting one or more pattern pieces from the layup, which may comprise a single layer of fabric or a plurality of layers or plies of fabric arranged in vertically stacked relation. In the drawing and in the description which follows the apparatus 12 is shown and described with reference to a layup of fabric which comprises a single ply of fabric to be cut, which is hereinafter referred to as the spread fabric. However, it should be understood that the term "spread fabric", as used herein, also includes a layup of fabric which comprises a plurality of individual plies or sheets of fabric arranged in vertically stacked relation to each other, and modified forms of the apparatus and methods hereinafter further described are contemplated for producing and processing multiply layer layups of relaxed or normalized spread fabric.

The illustrated apparatus 12 is particularly adapted for cutting a single part or pattern piece or a plurality of component parts or pattern pieces from spread fabric and includes a table 14 which defines a supporting surface 16 upon which a fabric layup is spread. A main carriage, indicated generally at 18, bridges the table 14 and is supported for movement in one and an opposite longitudinal direction relative to the table. A cutting head, indicated generally at 20, and supported on the main carriage for movement therewith and relative thereto in cutting engagement with the layup responds to positioning signals supplied by a numerically controlled or computerized controller designated generally by the numeral 22. The cutting tool includes a rotary blade or cutting wheel 24, which cooperates in cutting engagement with the supporting surface 16, capable of moving in cutting engagement with the layup along any line such as indicated at 26 which may be either straight or curved, as required, in cutting a given component or pattern piece from the layup.

A pair of ways 28, 28 mounted on the frame of the table at opposite sides of the supporting surface support the main carriage. The table also has a pair of elongated racks 30, 30 mounted in fixed position at opposite sides of the supporting surface adjacent the ways and parallel thereto.

The carriage 18 is supported for movement in one and an opposite direction longitudinally of the supporting surface 16 by a plurality of rollers (not shown) arranged for rolling engagement with top and side surfaces of the ways. A reversible drive motor 32 mounted on the carriage drives an associated pinion in engagement with one of the racks 30, 30 to move the carriage longitudinally of the table or in a direction indicated by the arrow X in response to command signals received from the controller 22, which is electrically connected to the carriage.

The cutting head 20 is supported on the carriage for movement transversely of the supporting surface 16 by a guide rod (not shown) which extends transversely of the carriage above the supporting surface and a lead screw (not shown) supported on the carriage in parallel alignment with the guide rod and driven by another reversible motor 34. The drive motor 34 drives the cutting head 20 in a transverse direction, as indicated by the arrow Y in response to signals received from the controller 22. Preferably, the cutting wheel 24 is arranged for rotation about a vertical axis in a direction indicated by the arrow (theta) in FIG. 1 and is rotated about the latter axis by a drive motor 35 associated with the cutting head 20 in response to signals received by the cutting head from the controller 22. Thus, the cutting wheel 24 may be programmed to move in cutting engagement with a layup or spread of fabric on the table 14 and along any predetermined path to cut from the layup a pattern piece such as the pattern piece P shown in FIG. 2. The cutting head 20 is also preferably arranged for vertical movement relative to the main carriage 18 so that the cutting wheel 24 may be raised from its normal cutting position to an elevated position wherein it is located above the layup.

The apparatus 12 further includes a fabric spreader indicated generally at 36 and adapted to receive and carry the supply roll S. The illustrated fabric spreader 36 includes a spreader carriage 37 supported for rolling engagement with and on the ways 28, 28 by rollers 38, 38 (two shown) which engage top and side surfaces of the ways. The fabric spreader is driven by a reversible motor 40 which carries a pinion 42 engaged with one of the racks 30, 30 and which receives command signals from the programmable controller 22 to move the spreader carriage in one or the opposite longitudinal direction relative to the table 14. A pay-off mechanism indicated generally at 44 in FIG. 2 and mounted on the spreader carriage 37 supports the bolt of fabric or supply roll S for rotation about an axis which extends transversely of the supporting surface. Another drive motor 46 which comprises part of the pay-off mechanism, receives command signals from the controller 22 and drives the supply roll S to pay-off fabric from the roll at a linear rate generally corresponding to the linear rate at which the fabric is layed up or spread on the supporting surface.

At least one feed roller is supported on the fabric spreader carriage for rotation about an axis parallel to the axis of the supply roll S, but preferably, and as shown, the apparatus 12 includes a plurality of feed rollers 48, 48. The feed rollers are driven in timed relation to the supply roll S and to each other by a drive mechanism 50 and function to maintain a free hanging loop of payed-off fabric F in a substantially slack condition within a slack region between the feed rollers indicated at R in FIG. 3.

The longitudinally extending threads of the fabric F within the region R may be under slight tension due to the weight of the fabric which comprises the free hanging loop, however, the magnitude of this stress is negligible, as compared to the magnitude of stress to which the threads are subjected when the fabric is wound to form the supply roll S. A sensing device, such as the illustrated photosensor, indicated generally at 52 which may, for example, comprise a photocell, phototube, phototransistor, or the like, indicated at 54 and a light source 55 is preferably connected through an amplifier 56 to the controller 22 which provides command signals to the drive mechanism to control the pay-off of fabric whereby a free hanging loop of slack fabric F is at all times maintained within the region R between the feed rollers 48, 48.

Further, and in accordance with the invention, a means is provided for vibrating payed-off fabric F between the supply roll S and the supporting surface 16 to effect excitation of an associated portion of the fabric before the fabric is spread onto the supporting surface. The applied vibration relieves residual stresses in the fabric and induces rapid return of the material to its relaxed or normalized state. In the illustrated embodiment 12 this vibratory motion is imparted to the fabric by a vibratory member or elongated bar 58 which is carried by the fabric spreader 36. The bar extends transversely of the spreader carriage 39 and substantially across the entire width of the carriage at its discharge end so that fabric payed-off the supply roll S engages and travels over the upper surface of the bar 58 as the spreader carriages moves relative to the supporting surface 16 to spread fabric F on the latter surface. Thus, the bar is adapted to engage an associated portion of the fabric web and vibrate it along its entire width.

Various drive means may be provided for imparting vibration to the bar 58. The bar may, for example, be driven by a plurality of high frequency electromagnetic transducers arranged to operate in unison as taught by Staelin in U.S. Pat. No. 2,949,707 for METHOD AND APPARATUS FOR GRINDING AND POLISHING SHEET GLASS, issued Aug. 23, 1960 and hereby adopted by reference as part of the present disclosure. Further, motors for transmitting mechanical vibrations at ultrasonic frequencies are known in the art and examples of such motors which may be adapted to vibrate a member in a range of frequencies which include ultrasonic frequencies are shown in U.S. Pat. Nos. 3,086,288 to Balamuth et al; 3,666,975 to Balamuth and 3,934,526 to Damast et al, which are adopted by reference as part of the present disclosure.

Preferably, and as shown, a vibrator control device 62 is provided for controlling the vibrator drive 60. The control device is preferably arranged to continuously vary the vibrational frequency output of the vibrator drive 60 so that vibrations are imparted to the bar 58 within a range of frequencies which include ultrasonic frequencies. Preferably, the vibrator control 62 is further arranged to continuously vary the amplitude of vibration imparted to the bar 58 as fabric F passes over it.

It should be understood that the vibratory control 62 may comprise a part of the controller 22 so that the vibrator drive is arranged to operate in timed relation to the operating cycle of the apparatus 12, that is, so that the vibrator drive will operate when the fabric spreader is operating in its spreading mode. However, for clarity of illustration, the vibratory control 62 is shown in FIG. 3 as a separate control unit.

Preferably, a means is provided to hold the fabric in fixed position on the supporting surface 16 after it has been spread and for this purpose the table 14 may comprise a suitable vacuum holddown table. Since the details of such a table construction are not essential to an understanding of the present invention, the table structure will not be further described. However, disclosure of a vacuum holddown table for use with a cutting apparatus of the type hereinbefore described is found in U.S. Pat. No. 4,444,078 to Pearl for APPARATUS FOR CUTTING SHEET MATERIAL, issued Apr. 24, 1984, and assigned to the assignee of the present invention. For further disclosure of such a table construction, reference may be had to the aforedescribed patent to Pearl, which is hereby adopted by reference as part of the present disclosure.

Prior to commencement of the spreading mode, the main carriage 18 moves to the right-hand end of the spreading table 14, as it appears oriented in FIG. 3, in response to a command signal received by the motor 32 from the controller 22. The fabric spreader 36 may be simultaneously driven toward the right-hand end of the table 14 in response to a command signal received by the fabric spreader drive 40 from the controller 22.

As the spreader carriage 37 advances or moves toward the left (FIG. 3), in response to operation of the fabric spreader drive 40, the pay-off drive 46 and the feed roller drive 50 operates to pay-off fabric while maintaining fabric in a slack condition within the region R. The payed-off fabric travels over the upper surface of the vibrating bar 58 which is preferably vibrating at continuously varying frequencies and amplitudes of vibrations. The controller 22 regulates the rate of spreader carriage advance and the rate of fabric pay-off so that the linear rate of pay-off is substantially equal to the linear rate at which the fabric is layed onto the supporting surface 16.

The vibrations imparted to the fabric, which may constantly vary in frequency and/or amplitude and preferably include frequencies within the ultrasonic frequency range to excite the threads in the fabrics so that the residual stresses within the bodies of the threads dissipate. The vibrations of shortwave length imparted to the fabric tend to excite the interengaging fuzzy surface projections on the threads which comprise the fabric. The induced activity of these surface projections produces sufficient relative movement between the various projections to effect release of the entanglement between associated projections. Thus, the fabric will undergo relaxation or shrinkage as it leaves the fabric spreader and is spread upon the supporting surface 16. The controller may be programmed to compensate for this shrinkage so that the fabric is payed-off onto the table at a proper rate and further stressing of the fabric by the spreading operation is avoided. When the advancing spreader reaches the limit of its forward travel, the fabric may be cut to separate the fabric spread on the supporting surface from the fabric on the supply roll S. A suitable conventional cutting or shearing mechanism (not shown) may be mounted on the fabric spreader 36 for this purpose, if so desired. If a multilayer layup is desired, the spreading mode hereinbefore described may be repeated to build a layup which includes a plurality of stacked layers of fabric.

Preferably, the cutting mode commences immediately upon completion of the spreading mode. However, if desired, the cutting and spreading modes may be performed simultaneouly. More specifically, after the fabric spreader 36 has advanced some distance during the spreading mode, the main carriage 18 may be activated by appropriate command signals from the controller 22 so that the cutting mode may commence. If a zoned vacuum holddown table is employed, such as disclosed in the aforementioned U.S. Patent to Pearl, vacuum holddown force may be applied to the table surface 16 only in the region in which the cutting wheel 24 is operating, therefore, the spreading operation may proceed substantially independently of the cutting operation.

In accordance with the invention, a cutting or other size-dependent operation is or may be performed upon the fabric immediately after it has been spread on the supporting surface. The term "immediately", as used in this specification and in the claims which follow, is intended to imply a substantially continuous operation, that is an operation wherein the fabric, after having been spread, is at once ready to have a size-dependent work operation be performed upon it. In practice, some interval of time may elapse between the spreading operation and the performance of the size-dependent work operation upon the spread fabric. However, it is contemplated that a size-dependent operation will be performed on the spread fabric not more than one hour after the fabric has been spread on the supporting surface. Specifically, the term "immediately" is intended to encompass all situations where fabric after having been spread is at once ready to be worked upon without risk of substantial change in dimension, even though time lapse of up to one hour may occur between the spreading operation and the performance of a subsequent size-related work operation upon the fabric.

I claim:

1. Apparatus for working on woven fabric wound on a supply roll and comprising a table defining a supporting surface upon which fabric may be spread, a fabric spreader for carrying a fabric supply roll and supported for movement in one and an opposite direction longitudinally of said supporting surface for spreading fabric from the supply roll onto the supporting surface, means for moving said fabric spreader in one and an opposite direction longitudinally of said supporting surface, means for paying-off fabric from the supply roll and onto said supporting surface as said fabric spreader moves longitudinally of said supporting surface, means for vibrating a portion of the fabric located between said supply roll and said supporting surface which portion extends across the full width of said fabric, means for continuously varying the frequency of vibration of said vibrating means instrument means for performing a work operation on the fabric spread on said supporting surface, and means for moving said instrument means longitudinally and transversely of said supporting surface and in working relation to fabric spread on said supporting surface to perform said work operation on the fabric spread on said supporting surface.

2. Apparatus for working on woven fabric as set forth in claim 1 wherein said means for vibrating the portion of said fabric comprises means for vibrating said portion within a range of frequencies including ultrasonic frequencies.

3. Apparatus for working on woven fabric as set forth in claim 2 wherein said apparatus includes a programmable controller and said means for moving said fabric spreader, said means for paying-off fabric and said means for moving said instrument means operate in response to command signals received from said programmable controller.

4. Apparatus for working on woven fabric as set forth in claim 3 wherein said vibrating means is mounted on said fabric spreader to move with said fabric spreader and relative to said supporting surface.

5. Apparatus for working on woven fabric as set forth in claim 1 including means for varying the frequency of vibration of said vibrating means.

6. Apparatus for working on woven fabric as set forth in claim 5 wherein said varying said frequency comprises means for continuously varying said amplitude.

7. Apparatus for working on woven fabric as set forth in claim 1 including means for controlling said paying-off means to maintain a slack condition in the payed-off fabric within a slack region between the supply roll and said supporting surface.

8. Apparatus for working on woven fabric as set forth in claim 7 wherein said vibrating means is disposed between said slack region and said supporting surface.

9. Apparatus for working on woven fabric as set forth in claim 1 wherein said vibrating means comprises a transversely extending vibratory member disposed between the supply roll and said supporting surface for engaging the portion of the fabric as the fabric is payed-off of the supply roll and onto said supporting surface and means for vibrating said vibratory member in engagement with the fabric as the fabric is payed-off of the supply roll and onto said supporting surface.

10. Apparatus for working on woven fabric wound on a supply roll and comprising a table defining a supporting surface upon which fabric may be spread, a programmable controller, a fabric spreader for carrying a fabric supply roll and supported on said table for movement in one and an opposite direction longitudinally of said supporting surface, means for moving said fabric spreader in one and an opposite direction longitudinally of said supporting surface in response to command signals received from said programmable controller, means for paying-off fabric from the supply roll and onto the supporting surface as said fabric spreader moves longitudinally of the supporting surface and in response to command signals received from said programmable controller, a vibratory member carried by said fabric spreader and extending transversely thereof between the supply roll and said supporting surface for engaging a portion of the fabric extending across the entire width of the fabric as the fabric is payed-off the supply roll and onto said supporting surface, means for vibrating said vibratory member in engagement with the fabric as the fabric is payed-off of the supply roll and onto the supporting surface, means for continuously varying the frequency of vibration of said vibrating member within a range of frequencies including ultrasonic frequencies, instrument means for performing a work operation on the fabric spread on said supporting surface, and means for moving said instrument means longitudinally and transversely of said supporting surface and in working relation to fabric spread on said supporting surface in response to command signals received from said programmable controller to perform a operation on the fabric spread on said supporting surface.

11. Apparatus for working on woven fabric as set forth in claim 10 including means for controlling said pay-off means to maintain a slack condition in the payed-off fabric within a slack region between the supply roll and said supporting surface.

12. Apparatus for working on woven fabric as set forth in claim 11 wherein said vibratory member is disposed between said slack region and said supporting surface.

13. Apparatus for working on woven fabric wound on a supply roll and comprising a table defining a supporting surface upon which fabric may be spread, a fabric spreader for carry a fabric supply roll and supported for movement in one and an opposite direction and longitudinally of said supporting surface for spreading fabric from the supply roll onto the supporting surface, means for moving said fabric spreader in one and an opposite direction longitudinally of said supporting surface, means for paying-off fabric from the supply roll and onto said supporting surface as said fabric spreader moves longitudinally of said supporting surface, means for vibrating a portion of the fabric located between said supply roll and said supporting surface which portion extends across the full width of said fabric means for continuously varying the amplitude of vibration of said vibrating means, instrument means for performing a work operation on the fabric spread on said supporting surface, and means for moving said instrument means longitudinally and transversely of said supporting surface and in working relation to fabric spread on said supporting surface to perform said work operation on the fabric spread on said supporting surface.

* * * * *